United States Patent [19]

Sherburne et al.

[11] 4,163,328

[45] Aug. 7, 1979

[54] MOVING TARGET SCREEN WITH IMPROVED OPTICAL CONTROL

[75] Inventors: Frederick B. Sherburne; Herman I. Pardes; Edward S. Hughes, all of Monmouth County, N.J.

[73] Assignee: The United States of America as represented by the Secretary of the Army, Washington, D.C.

[21] Appl. No.: 885,149

[22] Filed: Mar. 10, 1978

[51] Int. Cl.[2] ..... F41G 11/00

[52] U.S. Cl. ..... 35/25

[58] Field of Search ..... 35/25; 350/1.5, 1.6, 350/154, 155, 288, 290, 291; 273/101.1

[56] References Cited

U.S. PATENT DOCUMENTS

| | | | |
|---|---|---|---|
| 2,776,598 | 1/1957 | Dreyer | 350/155 |
| 3,288,625 | 11/1966 | Kauer | 350/1.5 X |
| 3,888,022 | 6/1975 | Pardes et al. | 35/25 |
| 3,964,178 | 6/1976 | Marshall et al. | 35/25 |

*Primary Examiner*—William H. Grieb

*Attorney, Agent, or Firm*—Nathan Edelberg; Jeremiah G. Murray; Daniel D. Sharp

[57] ABSTRACT

An electro-optical apparatus for marksmanship training wherein a simulated scene is presented on a screen by a motion picture projector. The marksman or trainee operates a weapon, which includes a module to develop a laser beam, to simulate firing at a target on the scene. The apparatus provides an improved optical system including a dichroic mirror which permits the light which projects the target scene to pass through the mirror for providing an improved scene illumination while reflecting substantially all the laser beam energy to activate a target hit detector.

5 Claims, 3 Drawing Figures

FIG. 1
PRIOR ART
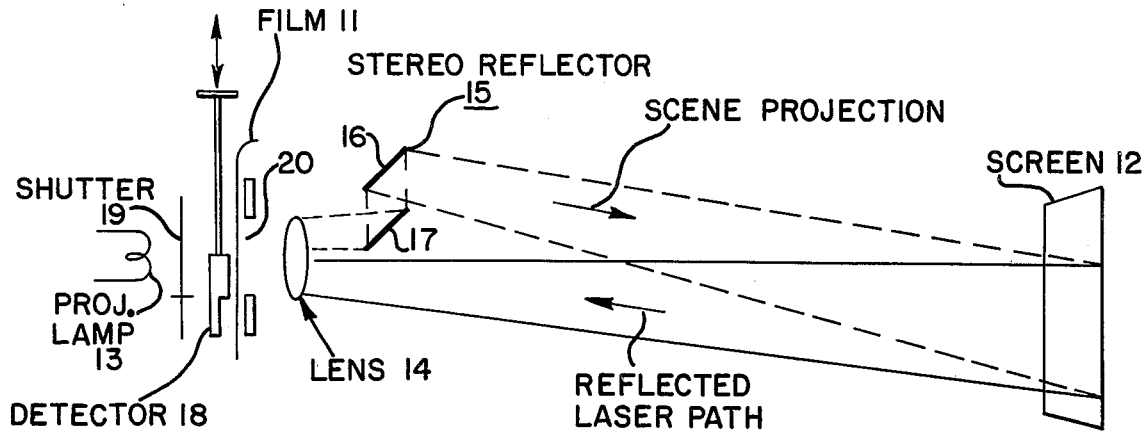
FIG. 2
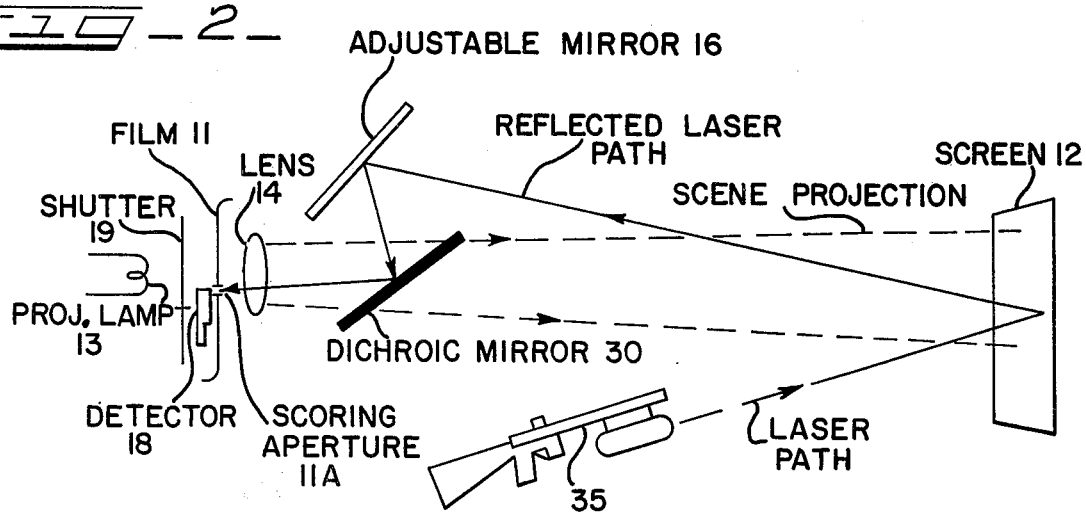
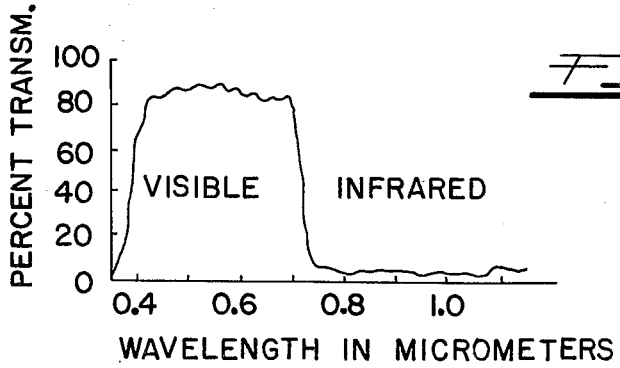
FIG. 3

MOVING TARGET SCREEN WITH IMPROVED OPTICAL CONTROL

The invention described herein may be manufactured and used by or for the United States Government for governmental purposes without the payment of any royalties thereon or therefor.

BACKGROUND OF THE INVENTION AND PRIOR ART STATEMENT

U.S. Pat. No. 3,888,022 entitled "Moving Target Screen" issued to Pardes, Schwartz, and Sherburne and assigned to the same assignee as the present invention discloses a system wherein motion picture scenes are projected on a screen to provide trainees with simulated realistic scenes for tactical and marksmanship training.

U.S. Pat. No. 3,888,022 discloses a system wherein each frame of the film contains a first portion representing a scene including at least one target area. Each frame of the film includes a second portion which is substantially opaque to laser radiation except for a transparent region thereof corresponding in location exactly to the location of the selected target area in the first portion of the film frame. The two portions of the film frames are superimposed to present only the target scene to the viewer. Each weapon has a low power laser unit attached thereto which can be excited by actuating the weapon trigger, and by automatic electronic controls, thereby firing a laser beam at the target. If the laser beam is properly aimed at the selected target area of the scene on the projection screen, the beam will be directed to reflect onto hit detection means while an improperly aimed laser beam will not reflect onto the hit detection means. Hits for all involved weapons are scored by electronic display means. When more than one weapon is to be fired, electronic multiplexing means are provided for synchronizing firing of the various weapons with film frame projection.

The present invention discloses and claims an improvement to the projection and reflective lens system of said U.S. Pat. No. 3,888,022.

Additional description of prior art U.S. Pat. No. 3,888,022 is included hereinbelow with reference to FIG. 1.

SUMMARY OF THE INVENTION

As stated below, the present invention discloses an improvement to the projection and reflective lens or optical system disclosed in U.S. Pat. No. 3,888,022. More specifically, the present invention utilizes a new lens system comprising a dichroic mirror and the new lens system provides a gain in scene illumination which is approximately two times brighter than that provided by the system of U.S. Pat. No. 3,888,022.

A number of other advantages and features, which will be discussed hereinbelow, are provided by the system of the present invention.

DESCRIPTION OF THE DRAWINGS

FIG. 1, labeled prior art, is a schematic illustration of the system optics of the prior art U.S. Pat. No. 3,888,022;

FIG. 2 is a schematic illustrating the fundamentals of the system optics of the present invention; and, FIG. 3 is a graph with the abscissa indicating wavelength in micrometers and the ordinate indicating percent transmission to show the percent transmission of visible light and of infrared light by the dichroic mirror utilized in the present invention.

DESCRIPTION OF FIG. 1 LABELED PRIOR ART

It should be appreciated at the outset, that while the lens system of the present invention is novel, the electronic circuitry and operation of the structure of the present invention is otherwise the same as that disclosed in U.S. Pat. No. 3,888,022.

FIG. 1 discloses the structure of the prior art as disclosed in U.S. Pat. No. 3,888,022. In FIG. 1, the image of each film 11 frame is projected onto the viewing screen 12 by a conventional projection lamp 13, shutter 19, condensing lens 14 and by way of a stereo reflector 15 consisting of two first surface mirrors 16 and 17. Mirror 16 is tiltable and adjustable relative to the stationary mirror 17. The direction of the projection of the images onto the screen 12 is indicated by the dotted lines. As discussed in detail in said patent, the upper half of each frame of film contains an inverted normal positive scene while the other or lower half of each frame contains a mask consisting of an opaque background in which there are one or more transparent apertures. The apertures are located at the same relative position on the mask portion of each film frame as a corresponding target or targets on the other portion of the film frame containing the scene. Thus, each projected film frame or image includes a scene portion and a lower mask portion within which respective bright spots appear. The moveable mirror 16 is adjusted until the bright spot in the mask portion is superimposed on the target in the scene portion of the projected image.

After the proper initial adjustment of the mirror 16 has been made, the hit detector 18 is moved into position so as to block light from the projection lamp 13 from passing through the lower half of the film gate 20. Accordingly, only the scene portion of the projected image will appear on the screen 12 and the bright spots of both projected images are removed from the scene projected onto the screen. The weapon operator or trainee thus sees only the actual target scene on the screen film frame and aims his weapon, which incorporates a laser module, to fire a laser beam at the target area imaged on the screen 12. If the weapon is accurately aimed on target, the laser beam is reflected from the screen as labeled in FIG. 1 to pass through lens 14 to impinge on detector 18.

It will be understood from the foregoing and from reference to FIG. 1 that only approximately one-half of the lens 14 is utilized to project the scene since about one-half of the illumination from the projection lamp 13 to the screen 12 is blocked out by detector 18.

DESCRIPTION OF THE PREFERRED EMBODIMENT OF THE INVENTION

Refer now to FIG. 2 which illustrates the improved lens or optical system according to the invention. More specifically, the lens system of the present invention incorporates a dichroic mirror 30, as will be explained. Dichroic mirrors which are known in the art (sometimes termed "hot" mirrors) may be designed such that only light frequencies within certain ranges pass therethrough, while light frequencies outside of the selected ranges are reflected.

In the present invention, and as shown in FIG. 3, a dichroic mirror 30 is utilized which passes light in the visible range, i.e. light of a wavelength up to approximately 0.75 micrometers; and, which reflects light in the infrared range, i.e. light of a wavelength above approximately 0.75 micrometers.

Note in FIG. 2 that the projection lamp 13, the shutter 19, the detector 18, the film 11 structure, the lens 14, the adjustable mirror 16, and the screen 12 are essentially the same as the similarly referenced elements in FIG. 1. However, in FIG. 2, the detector 18 is located in a position which does not shield or mask lens 14 from the light projected from lamp 13.

It should be noted that the dichroic mirror 30 is utilized instead of the first surface mirror 17 in the stereo reflector 15 of FIG. 1. The dichroic mirror 30 is positioned at approximately a 45° angle with the plane of the lens 14. The light from the projection lamp 13 passes through the entire lens 14 and the dichroic mirror 30 to illuminate the target scene on screen 12 as indicated by the dotted lines of FIG. 2.

It has been found that the mirror 30 transmits about 80% of the visible light in the scenes to the screen 12. Mirror 30 reflects the remainder of the light from lamp 13 upwardly toward the moveable mirror 16; and hence, does not reflect it back into the lens and optical system. The foregoing greatly reduces the high ambient signal initially incident on the detector module 18.

Similarly, as heretofore, the weapon operator or trainee aims his weapon 35 at the target scene and the infrared energy from the laser module is reflected from the screen 12 in the path indicated, onto the moveable mirror 16, which is adjustable to control the beam convergence. The infrared energy is reflected from the moveable mirror 16 to the dichroic mirror 30. It has been found that the dichroic mirror 30 reflects almost 90% of the infrared energy at 0.8 micrometers from the screen 12 toward the lens 14 and detector 18. If the operator or trainee has, in fact, hit the designated target, the laser beams reflected from the mirror 30, through lens 14 and the scoring aperture 11A in film 11 activates the detector 18 to indicate a hit.

It will be appreciated that in the present invention, the entire projection lens 14 is used to project the scene image. This contributes to the high brightness or intensity of the original target scenes as compared to the prior art, since this effectively increases the projection lens aperture.

A number of advantages are obtained by the optical system of the present invention including the feature that the larger effective areas for the laser receiving optics permit the use of lower power, safer laser simulator modules. Also, the inventive system provides a greatly increased brightness for the target scenes permitting operation of the moving target system in most classrooms with near normal incident light levels thereby greatly increasing the potential use or utility of the system. Further, the improved controlled optics have resulted in increased operational ranges; for example, the projectors can be located about forty four feet from the screen and the simulated laser weapons can be located about forty feet from the screen. In addition, the signal resulting from use of the improved optical system provides an improved signal to noise ratio which facilitates signal detection and processing.

While the invention has been particularly shown and described with reference to a preferred embodiment thereof, it will be understood by those skilled in the art that various changes in form and details may be made therein without departing from the spirit and scope of the invention.

We claim:

1. An electro-optical weapon firing training apparatus comprising a film projector and viewing screen, at least one weapon on which is mounted a laser means to trigger an infrared energy laser beam aimed toward said screen upon firing said weapon; said projector including optical means for projecting the images of said film for providing a target scene on said screen at which said weapon may be aimed to direct a laser beam thereat, and said screen reflecting said laser beam, said optical means including an optical lens and a dichroic mirror positioned in the path of the projected images, said dichroic mirror being positioned at an angle with respect to the plane of said lens for allowing a major part of the visible light to pass therethrough onto said screen while reflecting the remainder of said visible light in a direction away from said lens, infrared energy detection means, a first surface mirror moveably mounted in a position to receive the laser beam reflected from said screen and to reflect said laser beam onto said angled dichroic mirror, and said dichroic mirror further reflecting said laser beam energy through said lens to said detector means.

2. An apparatus as in claim 1 wherein said dichroic mirror is positioned at an angle of 45° with respect to the plane of said lens.

3. An apparatus as in claim 1 wherein said film projector includes a projection lamp and wherein substantially 80% of the light from said lamp passes through said lens and said dichroic mirror to illuminate the scenes on said screen.

4. An apparatus as in claim 1 wherein substantially 90% of the infrared energy is reflected by said dichroic mirror toward said lens and said detector means.

5. An apparatus as in claim 4 wherein said dichroic mirror transmits substantially 80 percent of all light energy in the visible range.

* * * * *